US010033145B1

(12) United States Patent
Slipper et al.

(10) Patent No.: US 10,033,145 B1
(45) Date of Patent: Jul. 24, 2018

(54) SLIP RING HAVING MULTIPLE BRUSHES AXIALLY APPLIED TO A SEGMENTED BUSBAR

(71) Applicants: Michael E. Slipper, Ridley Park, PA (US); Tristan M. Wolfe, Philadelphia, PA (US); Daniel J. Simmons, Tucson, AZ (US)

(72) Inventors: Michael E. Slipper, Ridley Park, PA (US); Tristan M. Wolfe, Philadelphia, PA (US); Daniel J. Simmons, Tucson, AZ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/603,058

(22) Filed: May 23, 2017

Related U.S. Application Data

(62) Division of application No. 15/171,385, filed on Jun. 2, 2016, now Pat. No. 9,793,669.

(51) Int. Cl.

| | |
|---|---|
| ***H01R 39/00*** | (2006.01) |
| ***H01R 39/38*** | (2006.01) |
| ***H01R 39/10*** | (2006.01) |
| ***H01R 39/08*** | (2006.01) |

(52) U.S. Cl.
CPC ..... *H01R 39/381* (2013.01); *H01R 39/00* (2013.01); *H01R 39/08* (2013.01); *H01R 39/10* (2013.01)

(58) Field of Classification Search
CPC ..... H01R 11/30; H01R 13/60; H01R 39/00; H01R 39/08; H01R 39/10; H01R 39/381; H01R 39/64
USPC ..... 439/27, 28, 29, 9; 310/232
See application file for complete search history.

(56) References Cited

U.S. PATENT DOCUMENTS

| | | | | |
|---|---|---|---|---|
| 3,842,301 | A * | 10/1974 | Smith | H01R 39/14 310/232 |
| 5,734,219 | A * | 3/1998 | Horski | H01R 39/42 310/148 |
| 7,699,635 | B2 * | 4/2010 | Weaver | H01R 4/2404 439/291 |
| 9,793,669 | B1 * | 10/2017 | Slipper | H01R 39/381 |
| 2015/0311772 | A1 * | 10/2015 | Tominaga | H02K 13/02 310/232 |
| 2015/0380888 | A1 * | 12/2015 | Jehkonen | H01R 39/64 439/18 |

* cited by examiner

*Primary Examiner* — Javaid Nasri
*Assistant Examiner* — Chandrika Prasad
(74) *Attorney, Agent, or Firm* — Charles Buskey

(57) ABSTRACT

The disclosed invention is a slip ring assembly that provides electrical power transfer to centrifugal turbomachinery while minimizing or eliminating the presence of wires in the flow path. The device transfers electrical power through a set of wires connected to a plurality of brushes that are held rotationally stationary, but allowed to displace axially or radially through a set of springs. The brushes make contact with conductive busbar rings, transferring electricity to the busbar rings. The busbar rings rotate with the centrifugal turbomachine with a set of wires that connect the busbar rings to the blades or other aerodynamic surfaces of the centrifugal turbomachine.

5 Claims, 6 Drawing Sheets

SLIP RING HAVING MULTIPLE BRUSHES AXIALLY APPLIED TO A SEGMENTED BUSBAR

35 U.S.C. 120 BENEFIT OF EARLIER FILING DATE IN THE UNITED STATES

This application is a Divisional Patent Application of U.S. patent application Ser. No. 15/171,385 filed on Jun. 2, 2016 and claims the benefit that same date. It is directed to non-elected Species III cited by the Examiner in the Office Action of Feb. 28, 2017 in the prosecution of U.S. patent application Ser. No. 15/171,385. This Divisional application has the same inventors (Michael E. Slipper, Triston Wolfe, and Daniel J. Simmons) as patent application Ser. No. 15/171,385, and contains no new matter.

CROSS REFERENCE TO RELATED APPLICATIONS

This application is related to a Divisional Patent Application of U.S. patent application Ser. No. 15/171,385 entitled "Axially Powered Slip Ring Assembly for Electrical Power Transfer to Centrifugal Turbomachinery," which has the same inventors (Michael E. Slipper, Triston Wolfe, Daniel J. Simmons) and is filed concurrently herewith.

STATEMENT OF GOVERNMENT INTEREST

The invention described herein may be manufactured and used by or for the Government of the United States of America for governmental purposes without payment of any royalties thereon or therefore.

BACKGROUND

Slip rings are designed to transfer power to rotating structures with an electromechanical device mounted on a shaft, typically to a motor. In modern applications of centrifugal turbomachinery, active flow control may be required to transfer power directly to the blades or other aerodynamic surfaces to enhance the performance of these systems. However, transferring power directly to aerodynamic surfaces is not typically done because these aerodynamic surfaces are often situated a considerable distance from the turbomachine shaft, making it difficult to apply power to the aerodynamic surfaces without running wires along the centerplate, or some other integral part in the flow path of the turbomachine. This results in a change in the fluid dynamics and performance degradation of the turbomachine.

Consequently, it is desirable to transfer power directly to the blades and other aerodynamic surfaces from the slip ring without the presence of wires in the flow path. This would not only reduce performance degradation, but it would also allow for alternative designs that accommodate the supply of discontinuous pulsed power to the aerodynamic surfaces of turbomachines.

SUMMARY

This invention is a novel slip ring assembly that transfers power directly to the rotating aerodynamic surfaces of a centrifugal turbomachine without placing wires in the turbomachine's flow path. An exemplary embodiment of the slip ring assembly comprises a non-conductive slip ring and a brush assembly. The non-conductive slip ring has two conductive busbar rings connected along its outer surface.

The conductive busbar rings are separated by a distance that prevents electrical shorting between them. There are two conductive brushes connected to the inner surface of the brush assembly. The first conductive brush maintains radial contact with the first conductive busbar ring to provide power to the slip ring assembly. The second conductive brush maintains contact with the second busbar ring to provide ground to the slip ring assembly. Electrical power is provided from a separate source to the first conductive brush via a wire connected to the first conductive brush through the brush assembly. The brush assembly is grounded with a separate wire connected to the second conductive brush through the brush assembly. Leads extend from an end of the slip ring assembly to connect the slip ring, and transfer power to the centrifugal turbomachine. Multiple brush assemblies can be used in other variations of this embodiment of the invention.

In an alternate embodiment of the invention, the brush assembly has a singular brush in axial contact with a single conductive busbar ring located on the face of the turbomachine impeller housing. A conductive brush extends from the brush assembly to connect to the conductive busbar ring. The conductive brush is backed by a spring to keep the conductive brush in contact with the conductive busbar ring. The opposite end of the brush assembly is fixed to a stationary portion (e.g. the bellmouth) of the turbomachine. A single wire provides power to the brush assembly from an external source. The brush assembly may be grounded by the conventional method of a second slip ring mounted along the shaft of the turbomachine or by a second brush and conductive busbar ring situated at a different radial distance from the first conductive brush and conductive busbar ring.

Another embodiment of the slip ring assembly comprises a segmented conductive busbar ring and a brush assembly with multiple brushes. The segmented conductive busbar ring is connected along the circumference of a housing face of the turbomachine impeller. The brush assembly may be fixed to a portion of the turbomachine such as a bellmouth or a portion of the housing. The brushes are backed by springs to ensure constant contact with the conductive busbar. A connector provides power to the brush assembly from an external source. The brush assembly may be grounded via a second slip ring connected to the shaft of the turbomachine or by a second brush and a non-segmented conductive busbar ring situated at a different radial distance from the first brush and segmented conductive busbar ring. In variations of this embodiment of the invention, multiple brush assemblies with multiple brushes can be used. The segmented busbar, used in conjunction with multiple brushes, allows pulsed power to be transferred to the turbomachine.

DRAWINGS

DETAILED DESCRIPTION

Figure 1:
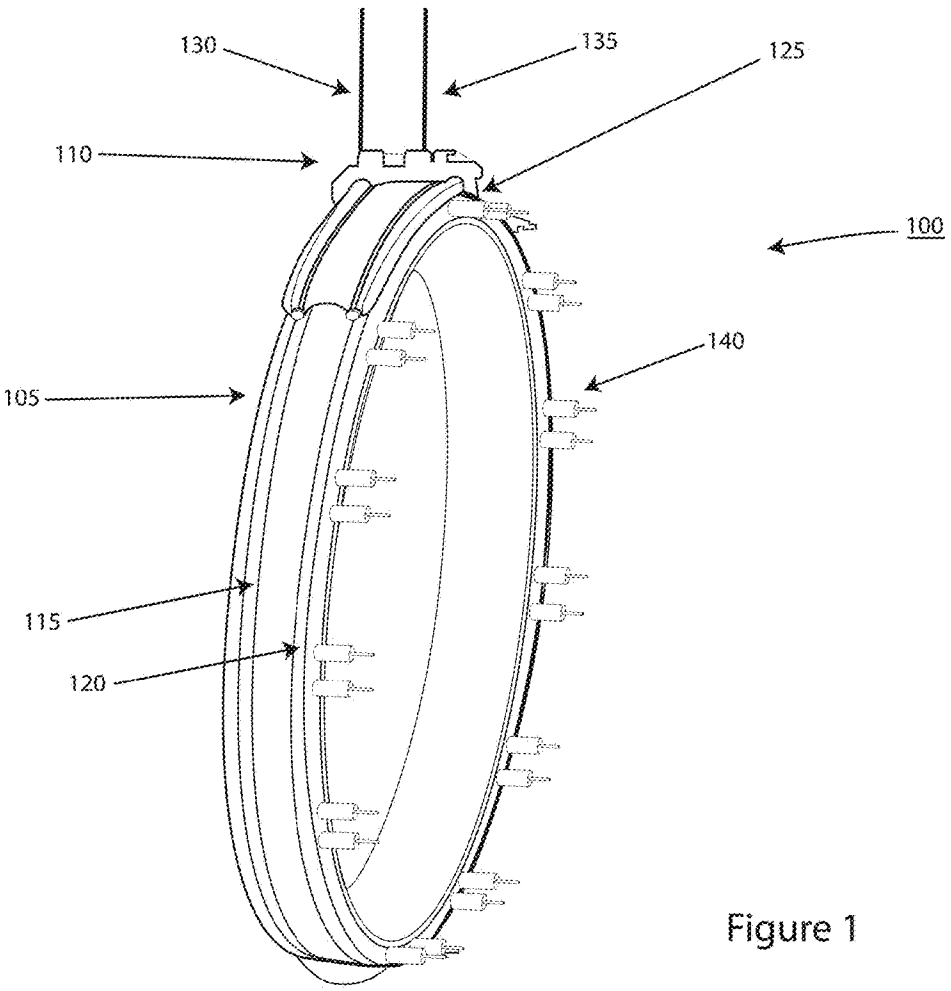
FIG. 1 shows an embodiment of the slip ring assembly with a brush assembly radially applied to conductive busbars on the slip ring.
Figure 2:
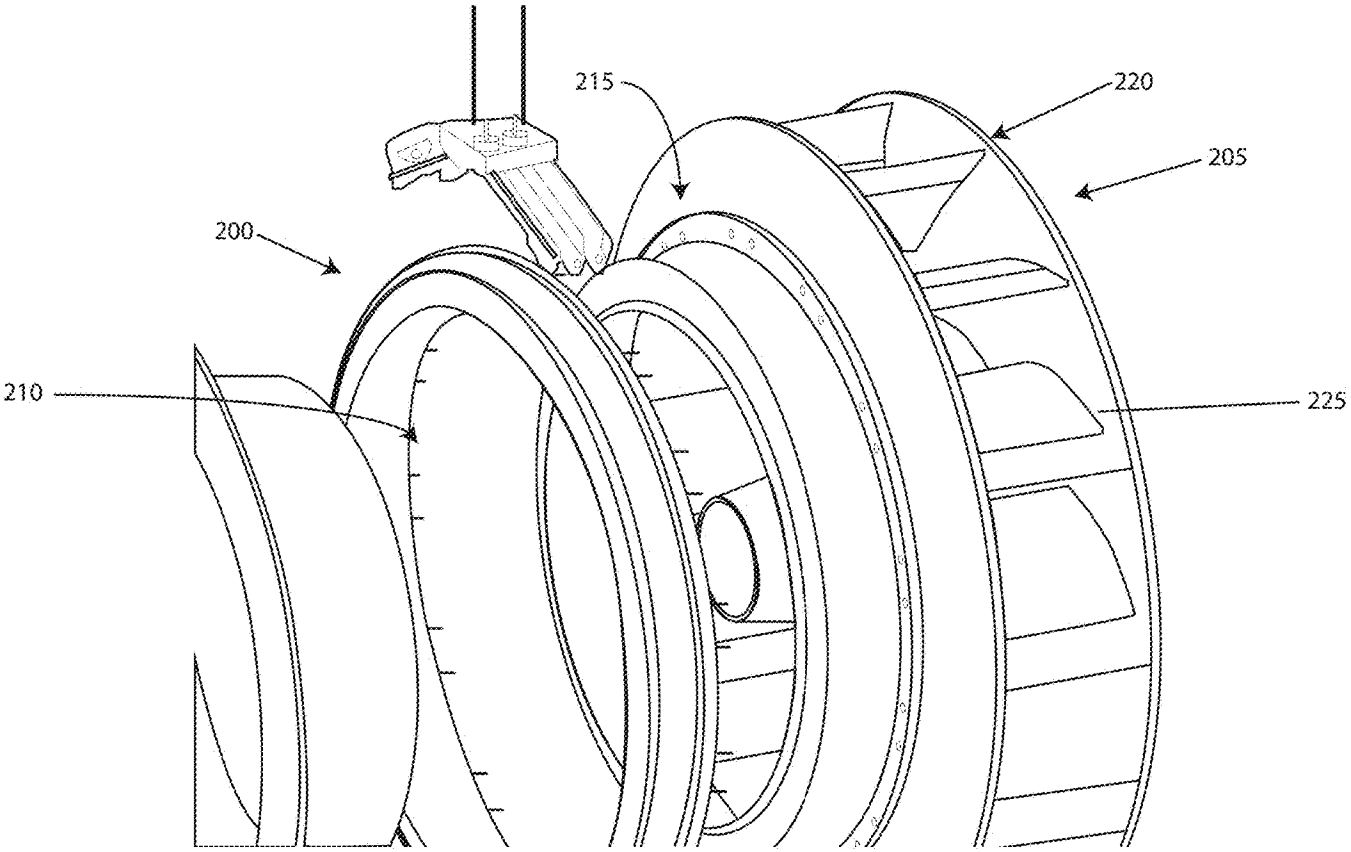
FIG. 2 is an exploded, left isometric view of the slip ring assembly with a brush assembly radially applied to conductive busbars on the slip ring, and the slip ring assembly being applied to the shroud of a turbomachine.

FIGS. 1 and 2 show exemplary embodiments of the slip ring assembly applied radially to a centrifugal fan shroud. FIG. 1 shows an isolated view of the slip ring assembly (100). The slip ring assembly (100) comprises a slip ring (105) and a brush assembly (110).

The slip ring (105) can be a variety of diameters and widths and fabricated from a variety of materials to accommodate various voltage and current requirements. The materials include, but are not limited to, a combination of conductive and non-conductive metals, polymers, and composites such as graphite, gold, copper, etc. In this embodiment, the slip ring (105) has two conductive busbars (115 and 120) connected along its outer surface. The first conductive busbar (115) is sufficiently separated from the second conductive busbar (120) to prevent electrical shorting at higher voltages.

The brush assembly (110), like the slip ring (105) can be fabricated from a variety of conductive and non-conductive materials. The brush assembly (110) has an oblong shape and is contoured to maintain radial contact with the slip ring (105). However, the brush assembly (110) can be shaped to work with alternate diameters and widths of slip rings. There are two conductive brushes (125) connected to each side of the inner surface of the brush assembly (110). The first conductive brush connects to the first conductive busbar (115) while the second conductive brush connects to the second conductive busbar (120). The conductive brushes (125) are backed by springs (not shown) to facilitate a constant connection to the conductive busbars (115 and 120). In alternate embodiments, multiple brush assemblies, with multiple brushes can be used to accommodate turbomachine requirements.

Power and ground are delivered to the brush assembly (110) by wires: power (130) and ground (135). In this embodiment, the power wire (130) and ground wire (135) connect to the top side of the brush assembly (115). However, it is contemplated that the power (130) and ground (135) wires can connect to any part of the brush assembly (110). The power (130) and ground (135) wires are electrically connected to the conductive brushes (125) on the inner surface of the brush assembly (110) to provide electrical power and electrical ground to the entire slip ring assembly (100). In the embodiment shown in FIG. 1, the power (130) and ground (135) wires are fabricated through the top of the brush assembly (110) to connect to the conductive brushes (125) on the inner surface of the brush assembly (110). In alternate embodiments the power (130) and ground (135) wires can be fabricated through different parts of the brush assembly (110). Also, in alternate embodiments, multiple conductive brushes can be used for power and ground to accommodate various power requirements. Moreover, in other embodiments, the slip ring assembly (100) can be grounded separately via an additional slip ring that connects to the shaft of the turbomachine.

FIG. 2, is an expanded view of the slip ring design with the brush assembly radially applied to a centrifugal fan shroud. The slip ring (200) attaches to the centrifugal fan impeller (205). In this embodiment, the fan shroud (215) of the centrifugal turbomachine is fabricated with holes (215) to accept leads (210) that extend from an end of the slip ring (200). The leads (210) transfer electrical power from the slip ring (200) directly to the turbomachine. In this embodiment, the leads (210) penetrate the fan shroud (215) and connect directly to the centrifugal fan blades (225). In alternate embodiments, the number and the positioning of the leads (210) and the shroud face holes (215) may be adjusted so that the leads can apply power directly to the blades (225) in alternate configurations.

Figure 3A:
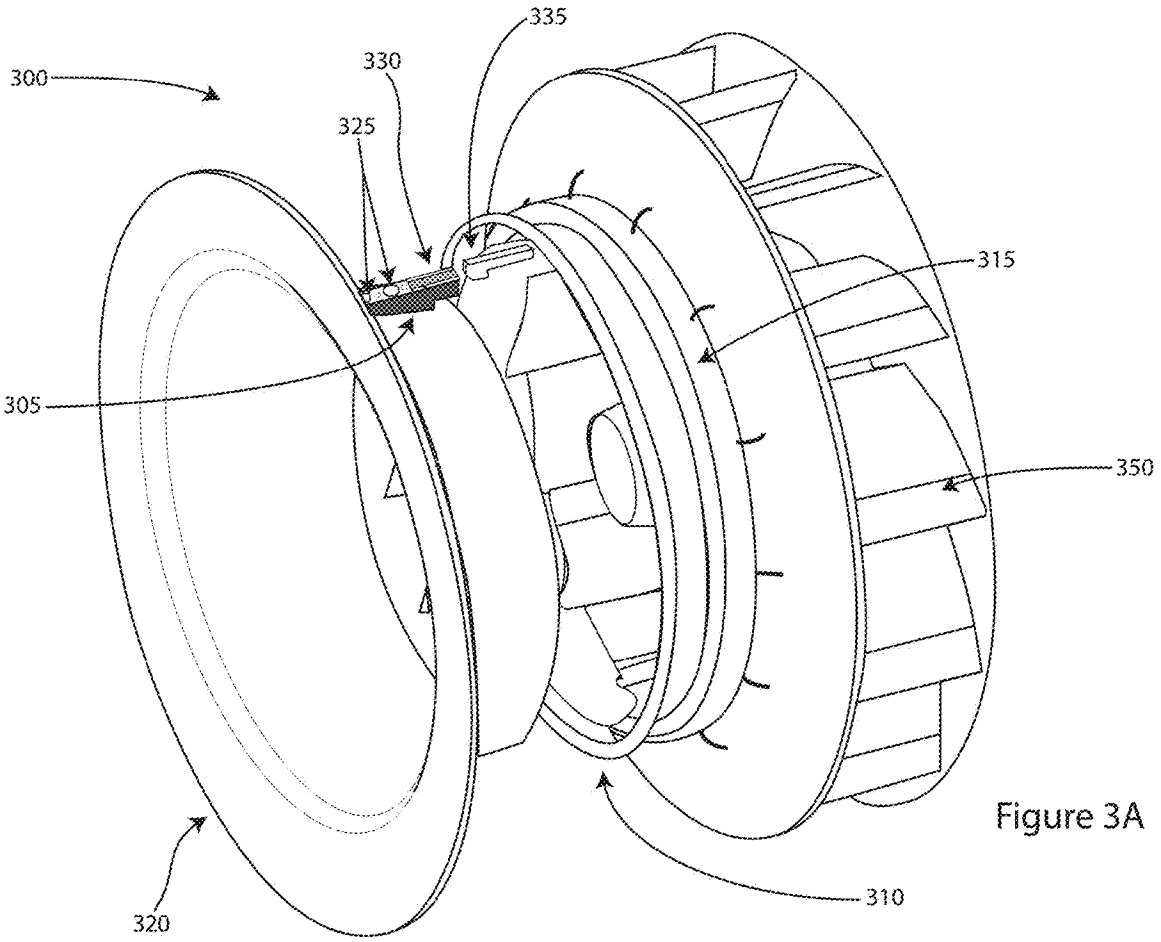
FIG. 3A is an exploded view of an alternate embodiment of the slip ring assembly with a brush assembly axially applied to a busbar on the shroud face of a turbomachine.

FIG. 3A shows an alternate embodiment of a slip ring assembly (300) with a brush assembly (305) axially applied to a conductive busbar (310) attached to the centrifugal fan shroud face (315). In this embodiment, the brush assembly (305) is designed so that one end of it attaches to the bellmouth (320) of the centrifugal turbomachine. The underside of the attached end of the brush assembly (305) is contoured to conform to the shape of the end of bellmouth (320) and is secured to the bellmouth (320) with bolts (325). In alternate embodiments, the brush assembly can be attached to other portions of the turbomachine or its housing. Instead of the bellmouth of the centrifugal fan, the brush assembly can be designed to attach to the volute (not shown) or some other housing of a centrifugal pump.

The other end of the brush assembly (305) is fabricated with a slot (330) to accommodate a conductive brush (335) that fits securely into the slot (330). As with other embodiments, the brush assembly (300) can be fabricated from a variety of conductive and non-conductive materials. In alternate embodiments, instead of using a slot, the conductive brush (335) can be fabricated directly into an end of the brush assembly (305) or attached to the brush assembly (305) in some other way to maintain contact with the busbar on the centrifugal fan shroud.

Figure 3B:
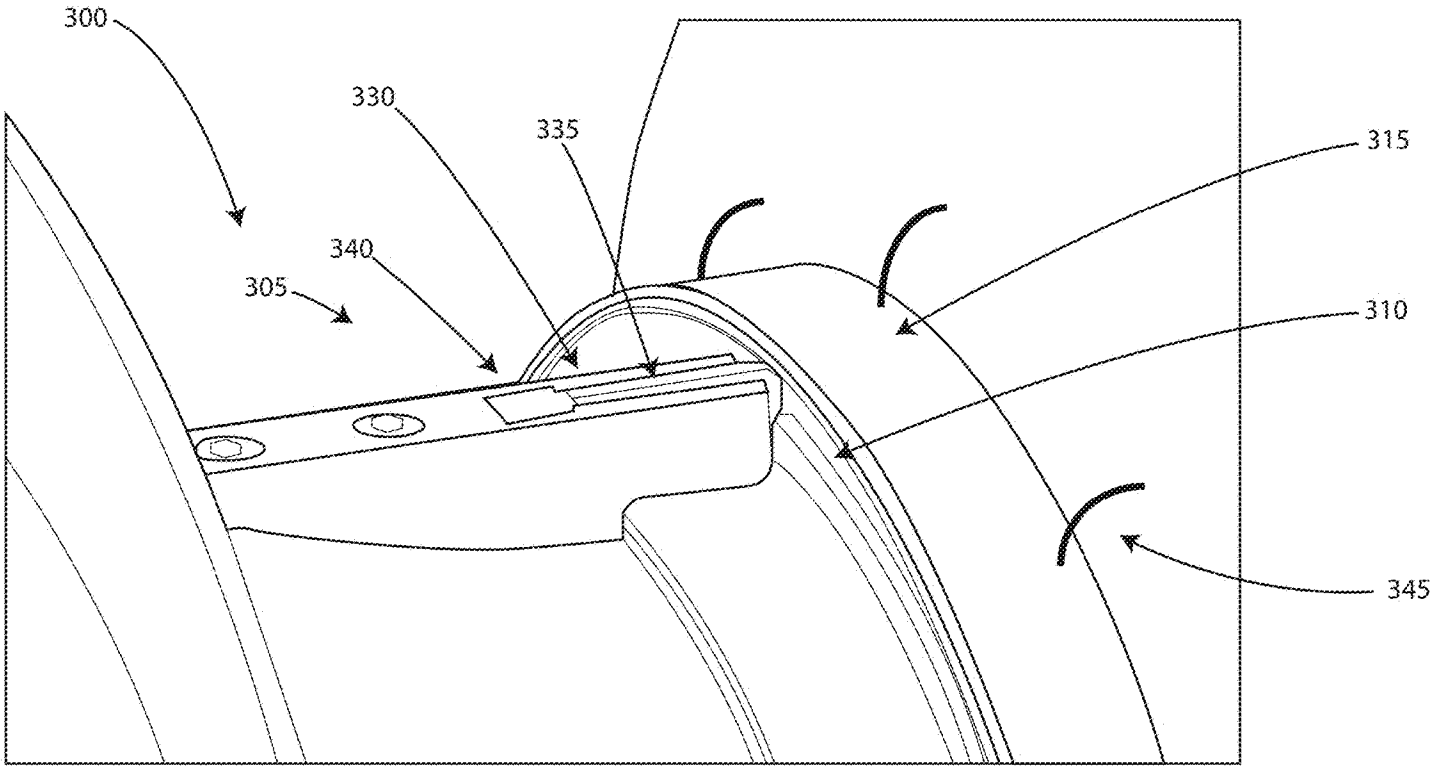
FIG. 3B is a close up view of the alternate slip ring assembly embodiment of FIG. 3A with a brush assembly axially applied to a busbar on the shroud face of a turbomachine.

Referring now to FIG. 3B, the slip ring assembly (300) is seen more clearly attached to the turbomachine with an exploded view. The trough-shaped slot (330) of the brush assembly (305) is shown with the conductive brush (335) inserted. The conductive brush (335) is back-loaded with a spring (340) to facilitate constant contact with the conductive busbar (310). In this embodiment, the conductive busbar (310) is machined onto the face of the centrifugal fan shroud (315). Electrical wires (345) extend through the centrifugal fan housing (310) to transfer electricity from conductive busbar (345) to the impeller blades (350) and provide them with power. In alternate embodiments the number and position of these electrical wires (345) can be adjusted to provide power directly to various locations on the impeller blades (350). Power is provided to the brush assembly (300) via a single connector or wire (not shown) from an external power source. The slip ring assembly can be grounded in a number of ways including with a separate ring mounted in a different radial location on the turbomachine.

Figure 4A:
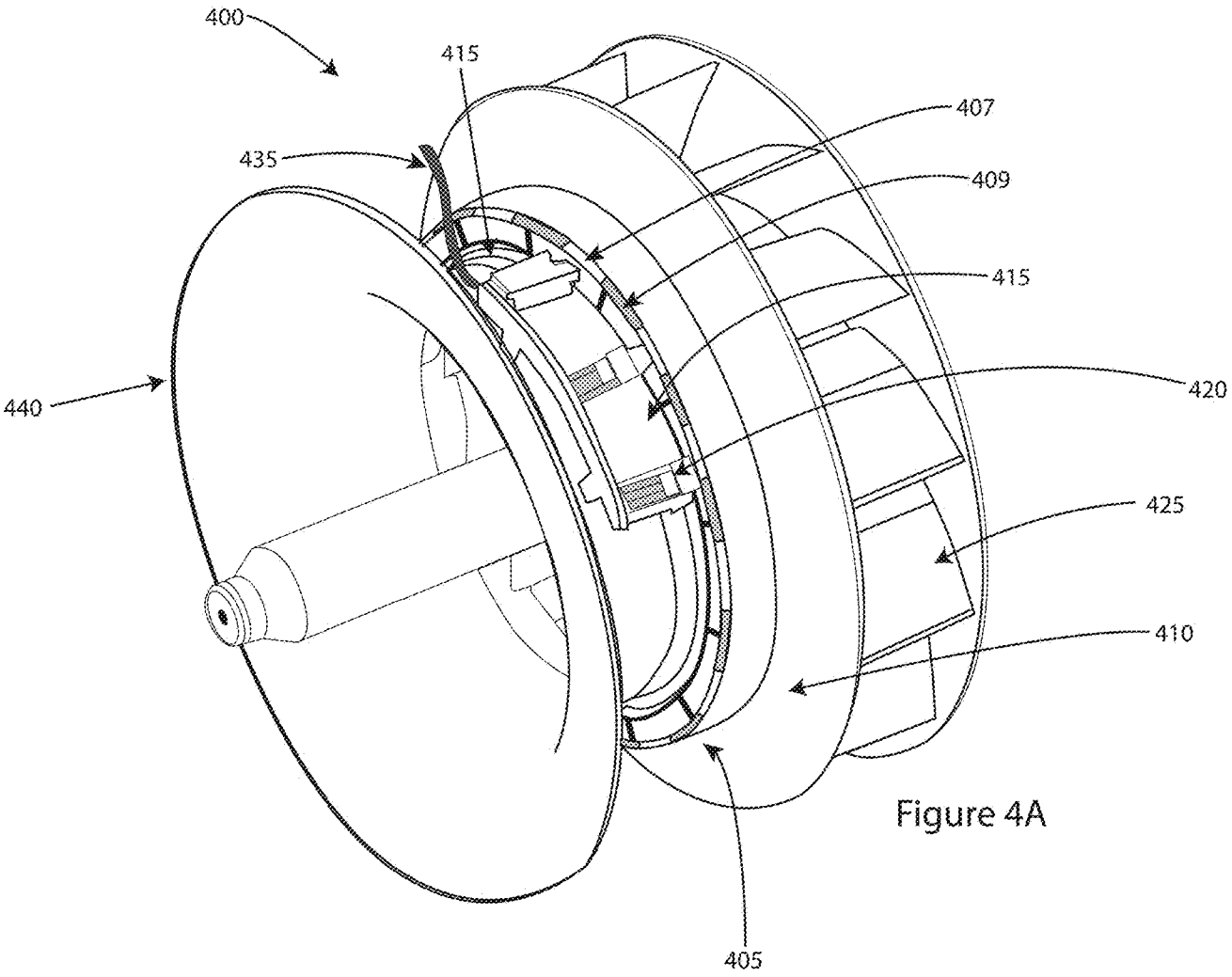
FIG. 4A shows another slip ring assembly embodiment with a brush assembly having multiple brushes, axially applied to a segmented busbar on the shroud face of a turbomachine.
Figure 4B:
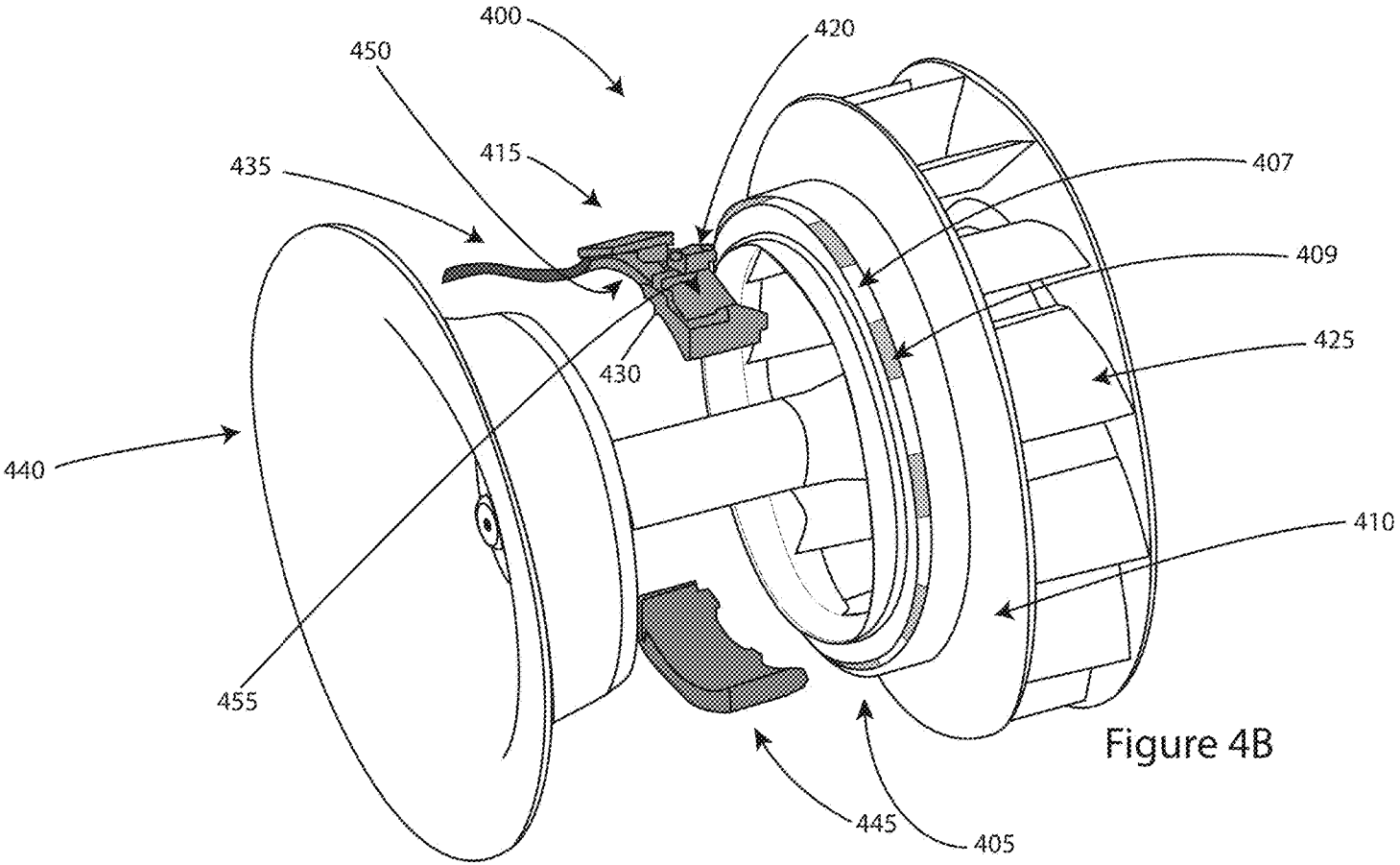
FIG. 4B is an exploded view of the slip ring embodiment of FIG. 4A having multiple brushes axially applied to a busbar of a shroud face of a turbomachine.

FIGS. 4A and 4B show versions of another alternate embodiment of a slip ring assembly (400) designed to accommodate pulsed power supplied to the centrifugal turbomachine fan blades (425). FIG. 4B is further expanded to more clearly show the details of the individual elements. In this embodiment, the conductive busbar (405) is segmented into conductive segments (409) and non-conductive segments (407) rather than one continuous conductive segment.

The conductive busbar (405) is fabricated onto the face of the centrifugal fan shroud or housing (410) of the turbomachine. In this embodiment, the brushes (420) are connected to the outer surface (455) of the brush assembly (415). However, the brushes (420) may be connected to an inner surface (450) or end of the brush assembly (415). The brushes (420) are spaced to provide power distribution to multiple impeller blades (425) at a time by making contact with the busbar conductive segments (409) and non-conductive segments (407) as the centrifugal fan assembly rotates. These brushes (420) are also backed by springs (430) to facilitate a constant connection to the conductive busbar (405).

The brush assembly (415) is axially applied to the turbomachine. A wire (435) or other type of connector provides power to the brush assembly from an external source. This embodiment can also be grounded by either a separate ground formed by a second conductive busbar/brush assembly located at a different radial location, or by a slip ring and wire connected through the shaft of the turbomachine. The brush assembly (415) may be secured to the bellmouth (440) of the turbomachine as shown in FIGS. 4A and 4B. Alternatively, the brush assembly (415) can be fixed to some other static portion of the turbomachine assembly. In addition, one brush assembly (415) can be used as shown in FIG. 4A or multiple brush assemblies (415) and (445) as shown in FIG. 4B. For example, a second conductive brush assembly (445) can fixed to the stationary housing such as the bellmouth (440) of the centrifugal turbomachine at a separate location than the first brush assembly to provide electrical ground to the slip ring assembly.

Although the invention has been described in detail with particular reference to preferred embodiments, other embodiments can achieve the same results. Variations and modifications of the present invention will be obvious to those skilled in the art and it is intended to cover, in the appended claims, all such modification and equivalents. The entire disclosure and all references, applications, patents and publications cited above are hereby incorporated by reference.

What is claimed is:

1. A slip ring assembly for providing electrical power transfer to a centrifugal turbomachine comprising:

a segmented busbar ring, with conductive segments and non-conductive segments, connected along an outer circumference of an impeller housing of the centrifugal turbomachine impeller;

a first brush assembly with an inner surface and an outer surface, wherein the inner surface of the brush assembly is fixed to a stationary housing of the centrifugal turbomachine, separate from the impeller housing, and wherein the brush assembly comprises:

a plurality of conductive brushes connected to the outer surface of the brush assembly to make contact with the conductive segments of the segmented conductive busbar ring; and an electrical connector connected to the brush assembly to provide electrical power to the brush assembly from an external power source; and a second conductive brush assembly fixed to the stationary-housing of the centrifugal turbomachine at a separate location than the first brush assembly to provide electrical ground to the slip ring assembly.

2. The slip ring assembly of claim 1, wherein the plurality of conductive brushes are spaced to provide power distribution to multiple impeller blades at a time by making contact with multiple conductive segments of the busbar ring as the centrifugal turbomachine impeller rotates.

3. The slip ring assembly of claim 1, wherein the conductive brushes are spring loaded on the outer surface of the brush assembly to facilitate constant contact with the segmented conductive busbar ring.

4. The slip ring assembly of claim 1, wherein the stationary-housing of the centrifugal turbomachine is a bellmouth of the turbomachine.

5. The slip ring assembly of claim 1, where the conductive busbar is fabricated on a face of a centrifugal fan shroud of the centrifugal turbomachine.

* * * * *